United States Patent [19]

Yoshikai

[11] Patent Number: 5,020,471

[45] Date of Patent: Jun. 4, 1991

[54] DEVELOPING UNIT

[75] Inventor: Tamio Yoshikai, Kyoto, Japan

[73] Assignee: Sharp Kabushiki Kaisha, Osaka, Japan

[21] Appl. No.: 367,184

[22] Filed: Jun. 16, 1989

[30] Foreign Application Priority Data

Jul. 6, 1988 [JP] Japan ..... 63-90106

[51] Int. Cl.[5] ..... G03G 15/06

[52] U.S. Cl. ..... 118/653; 118/657; 355/245; 355/260

[58] Field of Search ..... 118/653, 657, 658; 355/245, 253, 260

[56] References Cited

U.S. PATENT DOCUMENTS

| | | | |
|---|---|---|---|
| 4,338,019 | 7/1982 | Terashima et al. | 118/657 X |
| 4,595,277 | 6/1986 | Maczuszenko et al. | 355/253 X |
| 4,688,926 | 8/1987 | Manno | 118/653 X |
| 4,860,063 | 8/1989 | Okamoto | 355/246 X |
| 4,914,481 | 4/1990 | Yoshikai et al. | 355/245 |

FOREIGN PATENT DOCUMENTS

| | | |
|---|---|---|
| 58-9963 | 2/1983 | Japan . |
| 64-65583 | 3/1989 | Japan . |

*Primary Examiner*—A. T. Grimley
*Assistant Examiner*—Matthew S. Smith
*Attorney, Agent, or Firm*—Irell & Manella

[57] ABSTRACT

A developing unit including: a developing roller disposed in a developer tank in a location facing a recording medium; a supply passage for supplying developer to the developing roller; a shut-off device that is rotatable about the center axis thereof for opening and closing the supply passage; switching means that is provided with a spring clutch for transmitting rotational driving force to the shut-off device and is used for switching the shut-off device between the open and closed states; and a stopping position correcting mechanism for preventing variations in the stopping position of the shut-off device, the correcting mechanism having a clutch fixing plate mounted with screws on the outer wall of the developer tank in a slidable way around the center axis of the shut-off device and an engaging plate projecting from the clutch fixing plate and engaging with the case of the spring clutch.

8 Claims, 6 Drawing Sheets

DEVELOPING UNIT

BACKGROUND OF THE INVENTION

1. Field of the Invention

This invention relates to a developing unit used in a copying machine, a laser printer, etc. for developing, for example, an electrostatic latent image formed on a recording medium.

2. Description of the Prior Art

In a copying machine or the like, a developing unit is provided for making visible an electrostatic latent image formed on a recording medium such as a photoconductor by making toner, which is made from color pigment, adhere to the electrostatic latent image. Furthermore, some copying machines or the like are provided with a plurality of developing units containing toners of different colors for converting an electrostatic latent image into a color image, not merely into a black and white image, by selectively using the developing units.

Such developing units must be controlled so that toner will not adhere to the latent image when the units are not used for developing the image. For this reason, the developing gap (the gap between the recording medium and the developing section of the developing unit) is switched between different settings to prevent the toner from contacting with or being applied to the developing areas facing the recording medium.

However, changing the developing gap between different settings causes variations in the developing conditions, thus resulting in the variation in the copy image density or other trouble. Especially, if the positioning of the developing gap is not made precisely, it is not possible to invariably develop a normal image.

Some developing units employing a magnetic brush developing method are controlled in such a way that the developing brush does not contact the recording medium by shifting the positions of the magnets that form the developing section. However, failure to properly shift the positions of the magnets will not only cause variations in the copy image density but also lead to substantial deterioration of the copy quality because of the adherence of carrier to the recording medium (in the case of two-component developer).

Accordingly, the applicant of the present invention proposed a technique such as disclosed in Japan Patent Application No. 62-222661. This technique uses a developing roller disposed in a location facing a recording medium, a supply passage for supplying developer to the developing roller, a shut-off device for opening and closing the supply passage, and a switching means having a spring clutch for switching the shut-off device between the open and closed states, and offers the advantage that because the supply passage is opened and closed by operating the blocking plate of the shut-off device, the gap between the developing section and the recording medium is always maintained constant, and therefore, the developing conditions remain unchanged, thus assuring invariable production of normal copy images.

In the above construction, however, because the input and output sides of the spring clutch are fixed, it presents the problem that when the shut-off device is in a stop position, if the center axis of the shut-off device is not aligned with the center shaft of the spring clutch, rotational driving force is transmitted from the input side to the output side of the spring clutch because of the spring force within the clutch, thereby changing the stopping position of the shut-off device for opening or closing operation.

SUMMARY OF THE INVENTION

The developing unit of this invention, which overcomes the above-discussed and numerous other disadvantages and deficiencies of the prior art, comprises a developing roller disposed in a developer tank in a location facing a recording medium; a supply passage for supplying developer to the developing roller; a shut-off device that is rotatable about the center axis thereof for opening and closing the supply passage; switching means that is provided with a spring clutch for transmitting rotational driving force to the shut-off device and is used for switching the shut-off device between the open and closed states; and a stopping position correcting mechanism for preventing variations in the stopping position of the shut-off device, said correcting mechanism having a clutch fixing plate mounted with screws on the outer wall of the developer tank in a slidable way around the center axis of said shut-off device and an engaging plate projecting from said clutch fixing plate and engaging with the case of said spring clutch.

In a preferred embodiment, the center axis of said shut-off device is connected to a driving means so as to rotate around the axis thereof.

In a preferred embodiment, the center axis of said shut-off device is the center axis of a stirring roller for a stirring developer within the developer tank.

In a preferred embodiment, the shut-off device comprises flanges rotatably mounted on both ends of said center axis thereof, a pair of arch-shaped blocking plates fixed on the circumferences of said flanges, and a pair of arch-shaped openings formed between said two blocking plates.

In a preferred embodiment, the spring clutch is covered with a clutch cover that is provided with projections projecting radially of said center axis of said shut-off device to correspond with the position of said blocking plates.

In a preferred embodiment, a blocking plate position detecting switch is mounted on said clutch fixing plate of said developer tank.

In a preferred embodiment, the projections actuate said blocking plate position detecting switch.

In a preferred embodiment, the screws of said clutch fixing plate of said correcting mechanism are loosened to slide said fixing plate, so that the position of said position detecting switch is changed to adjust the opening or closing operation point of said blocking plates.

Thus, the invention described herein makes possible the objectives of (1) providing a developing unit that absorbs the dragging of the shut-off device caused by the spring force within the clutch even when the center axis of the shut-off device becomes more or less disaligned with the center axis of the spring clutch, thereby holding the shut-off device in a fixed stopping position; and (2) providing a developing unit that is capable of readily correcting the stopping position of the shut-off device.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Examples

Figure 1A:
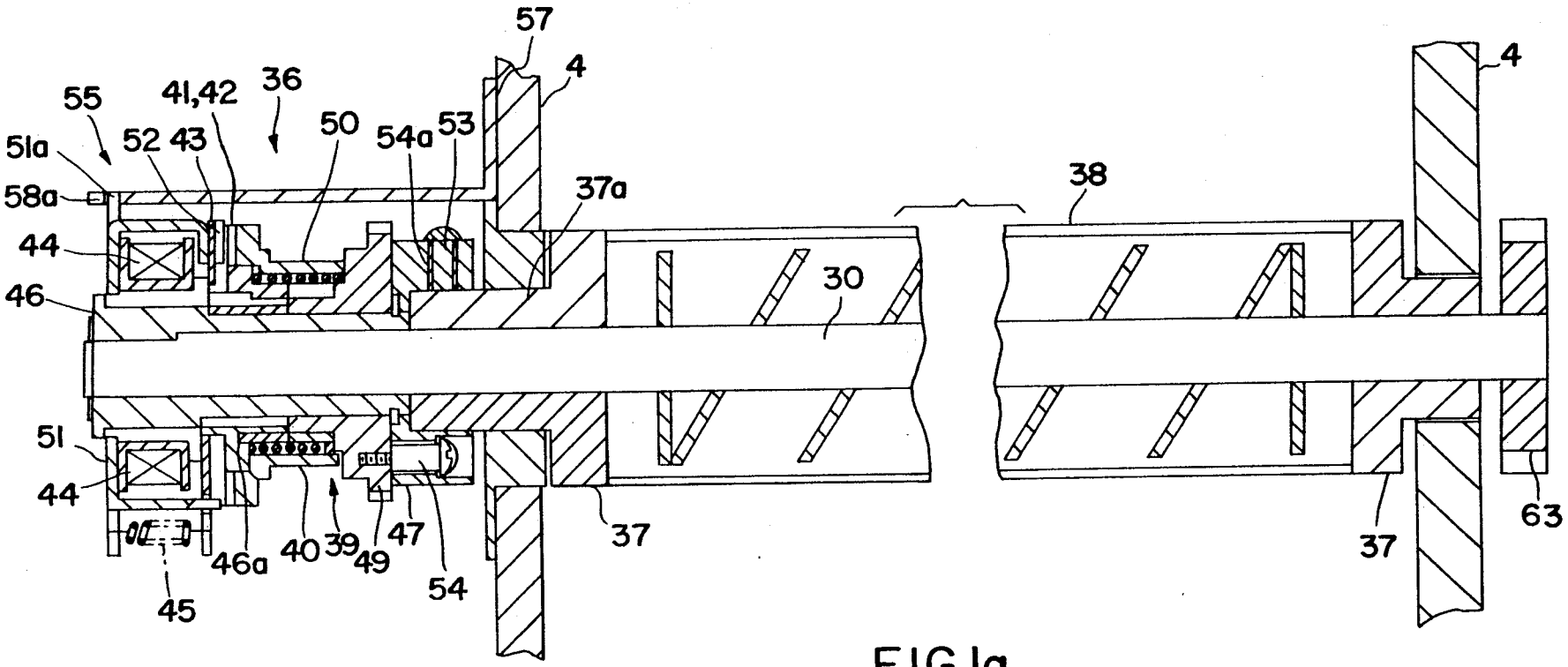
FIG. 1*a* is a cross sectional view showing the shut-off device of a developing unit of this invention.

The developing unit of this invention comprises, as shown in FIGS. 1*a*, 1*b*, 2*a* to 2*d*, and 4, a developer roller 22 disposed in a developer tank 4 in a location facing a recording medium 3; a supply passage 29 for supplying developer to the developing roller 22; a shut-off device 35 that is rotatable about the center axis thereof for opening and closing the supply passage 29; a switching means 36 that is provided with a spring clutch 39 for transmitting rotational driving force to the shut-off device 35 and is used for switching the shut-off device 35 between the open and closed states; and a stopping position correction mechanism 55 for preventing variations in the stopping position of the shut-off device 35, the correcting mechanism 35 having a fixing plate 57 mounted with screws 56*a* and 56*b* on the outer wall of the developer tank 4 in a slidable way around the center axis 30 and an engaging plate 58 projecting from the fixing plate 57 and engaging with the case 51 of the spring clutch 58.

Developer is supplied from a supply tank 20 to the developer roller 22, and when developing of a photoconductor 3 is completed and developing by the developing unit becomes unnecessary, the switching means 36 is operated to rotate the blocking plate 38 of the shut-off device 35 via the spring clutch 39 to close the developer supply passage 29, thus stopping further supply of the developer.

In the opening and closing operations of the blocking plate 38, if the rotational center axis 30 of the blocking plate 38 comes out of alignment with the center of a coil spring 50, the rotational force can be transmitted because of the force of the spring 50 even when the blocking plate 38 is in a stop position. In such a case, the stopping position correcting mechanism 55 absorbs the dragging of the shut-off device 35 caused by the spring force within the clutch even when the center axis 30 of the shut-off device 35 becomes more or less disaligned with the center shaft of the spring clutch 39, thus holding the shut-off device 35 in a fixed stopping position.

It would be possible to consider provision of a position correcting device in which a fixing screw 53 of a first hub 47 is loosened to rotate the blocking plate 38 about the center axis 30 and re-fix it into position. This could, however, lead to failure to transmit the driving force from the spring clutch 39 to the blocking plate 38 because of the tightening torque of the fixing screw 53, resulting in slipping of the driving force, or cause the center of the clutch to become disaligned.

According to the present invention, on the other hand, the screws 56*a* and 56*b* of the clutch fixing plate 57 of the correcting mechanism 55 are loosened to slide the fixing plate 57, thus changing the position of a position detecting means 61 to adjust the opening or closing operation point of the blocking plate 38. Because the adjustment of the screws can be made on one side of the developer tank 4, it is possible to provide stable operating performance of the blocking plate 38, and also, it is easy to work on adjustment.

Figure 5:
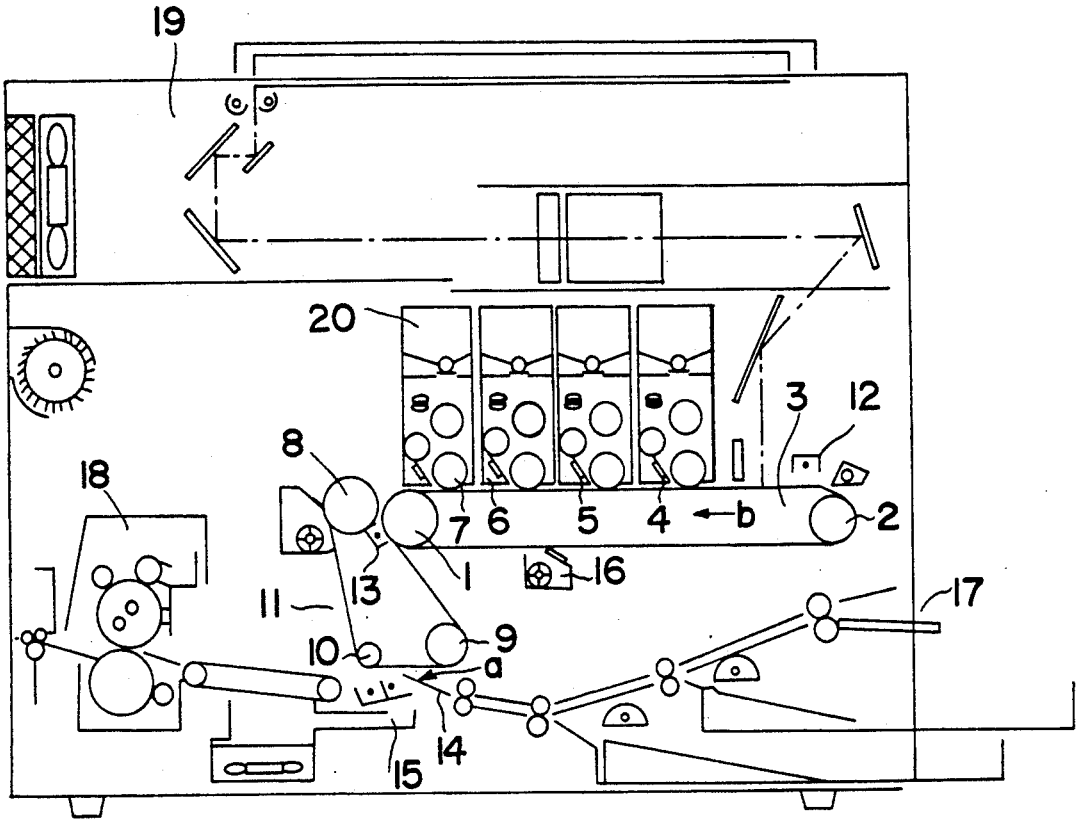
FIG. 5 is a block diagram showing the electrophotographic process of a copying machine with the developing unit of this invention.

This invention is described in detail below:

FIG. 5 shows a copying machine with the developing unit of this invention, which comprises: a photoconductor 3, an endless-belt-like recording medium which is applied on a pair of drive rollers 1 and 2; a plurality of developer tanks 4, 5, 6 and 7 disposed adjacent to the photoconductor 3 and switchable between the developing and non-developing positions; an endless-belt-like intermediate transfer member 11 which is applied on rollers 8, 9 and 10 at the side of the drive roller 1 in a contacting array with the photoconductor 3; a main charger 12 disposed at the side of the other drive roller 2; a first transfer charger 13 disposed adjacent to the intermediate transfer member 11; a second transfer charger 15 disposed beneath a copy paper 14 transported to the intermediate transfer member 11; and a cleaning blade 16 disposed under the photoconductor 16. The reference numeral 17 is a paper feed unit, 18 a fuser unit, and 19 an exposure unit. On each of the developer tanks 4 to 7 is disposed a supply tank 20.

Figure 4:
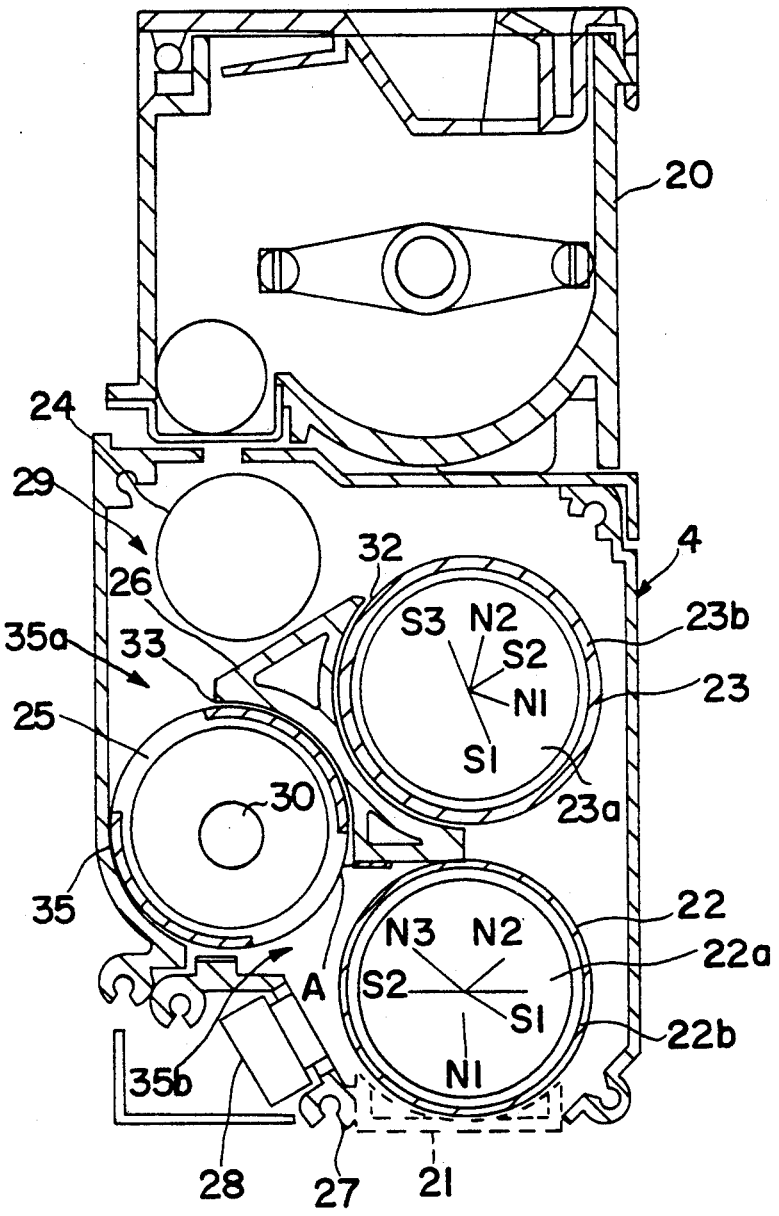
FIG. 4 is a cross sectional view showing a developer tank of the developing unit.

Because the developer tanks 4 to 7 are identical in construction, description is given below about the construction of the developer tank 4. As shown in FIG. 4, the developer tank 4 includes: a developing roller 22 which is a developing section rotatably mounted and disposed in an opening 21 for distribution of toner to the photoconductor 3; a developer transport roller 23 rotatably mounted above the developer roller 22; a first stirring roller 24 for stirring the developer scraped from the transport roller 23; a second stirring roller 25 as a means for stirring the developer supplied from the first stirring roller 24 and distributing it to the developing roller 22; and a partition member 26 interposed between the developing roller 22, the transport roller 23, the first stirring roller 24 and the second stirring roller 25 and scraping developer from the transport roller 23, thereby distributing the developer to the first stirring roller 24. Furthermore, in the developer tank 4 are contained a doctor 27 disposed with a given clearance from the developer roller 22 and a toner density sensor 28 for detecting the density of the developer. Between the developer tank 4 and the partition member 26, is formed a supply passage 29 for circulating and distributing the developer to the developing roller 22.

The developing roller 22 comprises a developing magnet member 22*a* fixed to the developer tank 4 and having magnets whose outer ends are magnetized N1, N2, N3, S1 and S2, and a cylindrically shaped non-magnetic aluminum developing sleeve 22*b* fitted around the developing magnet member 22*a* in a freely movable way and rotatably supported to the developer tank 4.

The transport roller 23 has the same construction as the developing roller 22, and comprises a transport magnet member 23a fixed to the developer tank 4 and having magnets whose outer ends are magnetized N1, N2, S1, S2 and S3, and a cylindrically shaped non-magnetic aluminum transport sleeve 23b fitted around the transport magnet member 23a in a freely movable way and rotatably supported to the developer tank 4.

Figure 3:
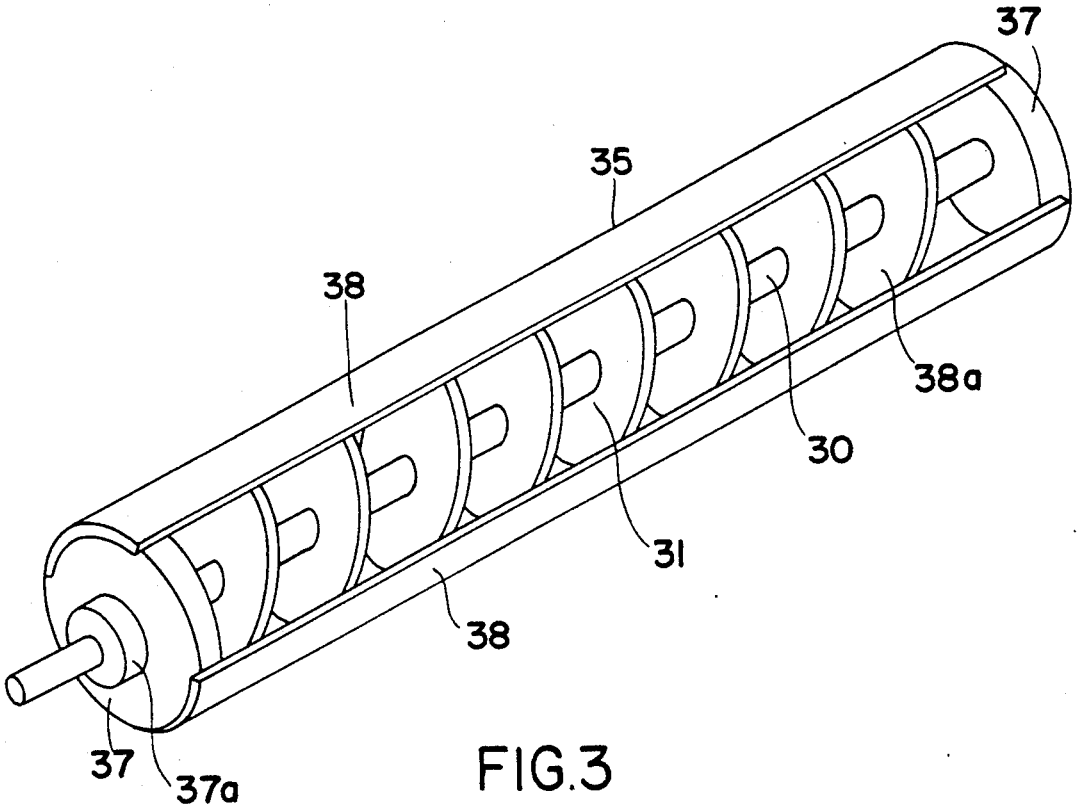
FIG. 3 is a perspective view showing the shut-off device.

The second stirring roller 25 comprises, as shown in FIG. 3, a center axis 30 which is rotatably supported to the developer tank 4, and a plurality of stirring fins 31 disposed on the center axis 30.

The surfaces of the partition member 26 that face the transport roller 23 and the second stirring roller 25 are formed in an arched shape, the partition member 26 being disposed with a minimum clearance between the arched surfaces 32 and 33 and the rollers 23 and 25 respectively. However, the clearance A between the stirring fins 31 of the second stirring roller 25 and the corresponding arched surface 33 of the partition member 26 is made larger by the thickness of the blocking plate 38 (FIG. 3) hereinafter described than the clearance to the transport roller 23. The wall surface of the developer tank 4 that faces the second stirring roller 25 is also formed in an arched shape to provide the same clearance as described above. Furthermore, the partition member 26 is slanted downward, as shown in FIG. 4, from the transport roller 23 toward the second stirring roller 25. Toner is stored in the supply tank 20 mounted on the developer tank 4, and is distributed to the areas adjacent to the first stirring roller 24 in response to the instruction from the developer toner density sensor 28. The developer mixed and stirred with the toner by the first stirring roller 24 is then distributed through the path along the partition member 26 to the second stirring roller 25.

In the supply passage 29, a developer entrance 35a is formed between the first stirring roller 24 and the second stirring roller 25 by the developer tank 4 and the partition member 26, while a developer exit 35b is formed between the second stirring roller 25 and the developing roller 22 by the developer tank 4 and the partition member 26. A shut-off device 35 is provided to control distribution of the developer from the first stirring roller 24 to the developer roller 22 by opening or closing the entrance 35a and/or the exit 35b, and a switching means 36 (FIG. 1a) to switch the shut-off device 35 between the open and closed states.

The shut-off device 35 comprises, as shown in FIGS. 1 and 3, flanges 37 rotatably mounted on both ends of the center axis 30 of the second stirring roller 25, a pair of arch-shaped blocking plates 38 fixed on the circumferences of the flanges 37 at the symmetric positions with respect to the center axis 30, and a pair of arch-shaped openings 38a formed between the two blocking plates 38.

The switching means 36 comprises, as shown in FIGS. 1a, and 2a–2d, a spring clutch 39 mounted on one end of the center axis 30, a plate-like armature 43 which is engaged with and disengaged from four pawls 41 and 42 disposed at equal spacing (90-degree spacing) on the outer flange 40a of the cylindrically shaped clutch cover 40 of the clutch 39, a solenoid 44 which forcibly moves the armature 43 in the direction to disengage it from the pawls, and a return spring 45 which pushes the armature 43 in the direction to engage it with the pawls.

Figure 2A:
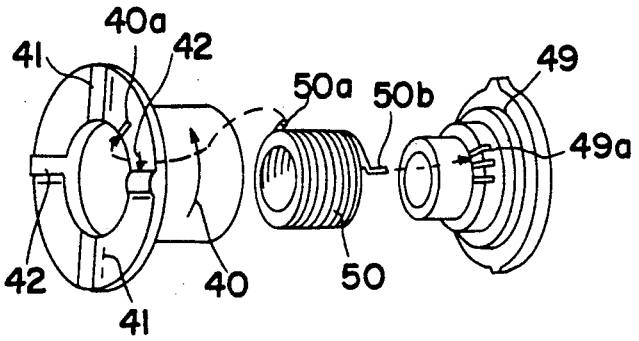
FIG. 2*a* is a perspective view showing the engagement of a coil spring of the developing unit.
Figure 2B:
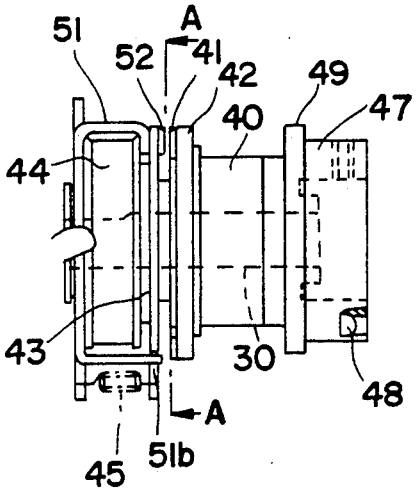
FIG. 2*b* is a side view showing the exterior of a spring clutch of the developing unit.
Figure 2C:
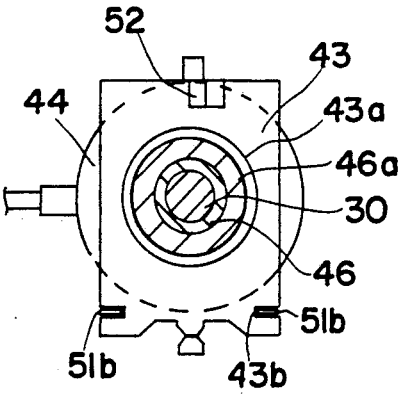
FIG. 2*c* is a sectional view showing the spring clutch taken along line A—A of FIG. 2*b*.
Figure 2D:
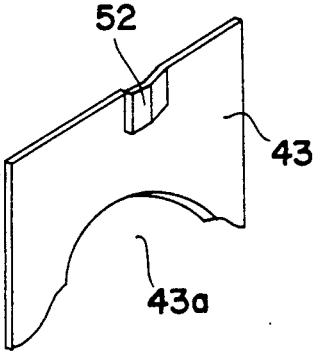
FIG. 2*d* is a perspective view showing an armature of the developing unit.

The spring clutch 39 comprises, as shown in FIGS. 1a, 2b and 2c, a clutch shaft 46 which is fitted and fixed to the center axis 30, a boss block 46a fitted on the clutch shaft 46, a first hub 47 which is fitted and fixed to the shaft 37a of the flange 37, a second hub 49 connected to the first hub 47 with a stepped tapping screw 48, a coil spring 50 wound between the second hub 49 and the boss block 46a, and the clutch cover 40 disposed around the spring 50.

The coil spring 50 has, as shown in FIG. 2a, one end 50a engaged with a notch 40a in the clutch cover 40 and the other end 50b fixed to a notch 49a in the second hub 49. The spring 50 is wound in the direction to clamp the boss block 46a. It is so constructed that the spring 50 is put in a state separated from the boss block 46a, i.e., in a loosened state, when a braking force is applied to the clutch cover 40 (restricting the rotating motion), thus disabling transmission of the rotational force of the center axis 30.

The armature 43 has, as shown in FIGS. 1a, 2b and 2c, its center hole 43a fitted on the clutch shaft 46 in a freely movable state and its lower end 43b engaged with and supported to the inner end 51b of a case 51 on the outer wall of the solenoid 44, the case 51 being fixed to the correcting mechanism 55. In the center of the upper end of the armature 43 is formed a stopper 52 which engages the pawls 41 and 42 of the clutch cover 40, the outer surface thereof contacting the upper end of the case 51. The return spring 45 is interposed between the lower end of the solenoid case 51 and the lower end 43b of the armature 43.

The first hub 47 has a through hole 54a formed in the circumference thereof, into which a fixing screw 53 is radially fitted, the fixing screw 53 being fitted into the through hole 54 and press contacting the shaft 37a of the flange 37 to fix the flange 37 to the first hub 47.

The second hub 49 is rotatably mounted on the clutch shaft 46, the second hub 49 being connected to the first hub 47 with a stepped tapping screw 54.

Figure 1B:
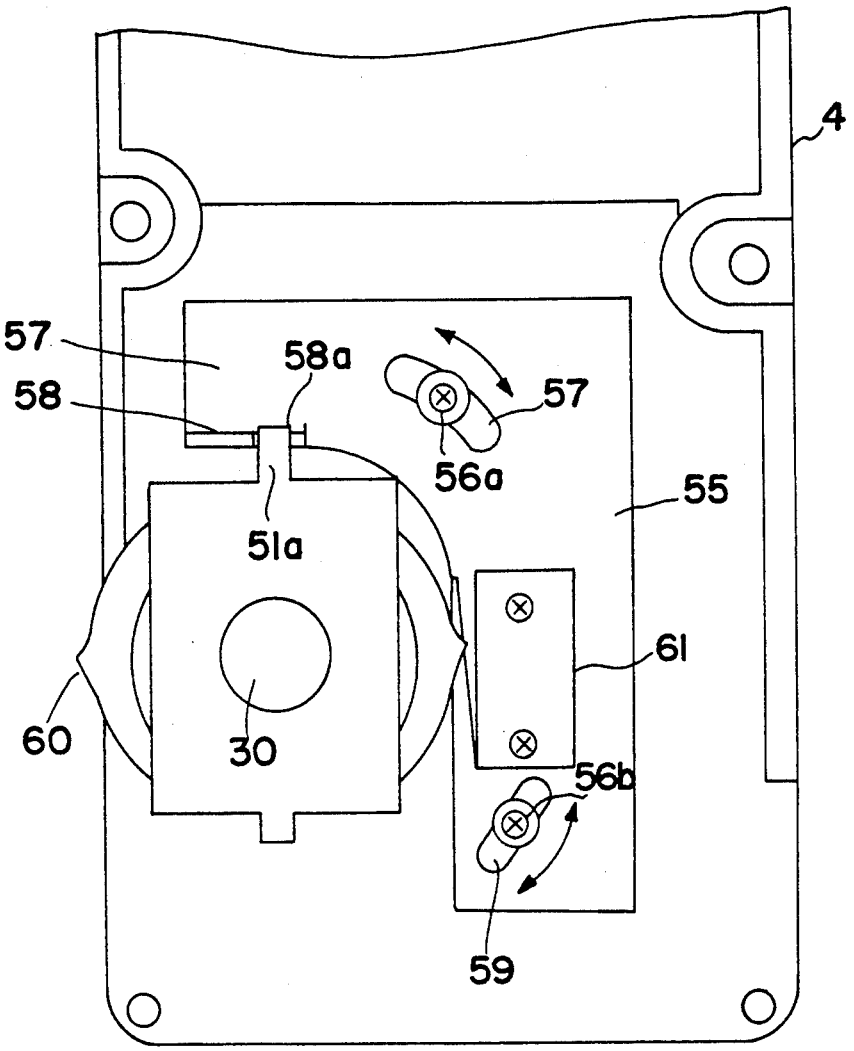
FIG. 1*b* is a side view showing a position correcting mechanism of the developing unit.

The stopping position correcting mechanism 55 is provided to prevent variations in the stopping position of the blocking plate 38 caused by the dragging of the spring clutch 39 or other factors. The stopping position correcting mechanism 55 comprises, as shown in FIG. 1b, a clutch fixing plate 57 mounted with screws 56a and 56b on the outer wall of the developer tank 4 in a slidable way around the center axis 30, an engaging plate 58 projecting from the clutch fixing plate 57 toward the clutch case, and a protrusion 51a formed on the clutch case 51 in a way to engage with a notch 58a the engaging plate 58.

The screws 56a and 56b are fitted in arch-like elongated holes 59 formed in the clutch fixing plate 57.

Furthermore, on the second hub 49 is formed protrusions 60 projecting radially of the center axis 30 to correspond with the position of the blocking plates 38, while a blocking plate position detecting switch 61 which is actuated by the protrusion 60 is mounted on the clutch fixing plate 57 of the developer tank 4.

To the opposite end of the center axis 30 from where the spring clutch 39 is mounted, is fixed a driving gear 63 to which rotational force is transmitted for rotation of the stirring roller 25 in a given direction.

The copying operation of the above copying machine is illustrated below.

When the copy switch is pressed ON, the photoconductor 3 starts to rotate in the direction of the arrow b shown in FIG. 5 at a constant surface speed. After the photoconductor 3 is charged by the main charger 12 and exposed to the light, the developer tank 4 is put into a developing position as required to contact the developer brushes with the photoconductor 3, thus developing the image on the photoconductor 3. When the photoconductor is not in the developing process, developer of the developer tanks 4 to 7 will not form brushes on the developing roller 22 because of the function of the shut-off device 35.

The developed toner image is moved in the direction of the arrow b and is transferred onto the intermediate transfer member 11 by means of the first transfer charger 13, after which the image is transferred in the direction of arrow a onto the copy paper by means of the second transfer charger 15, and then the image is fused.

To put the developer tank 4 in the developing operation, the passage 29 for supplying developer to the developing roller 22 must be opened. To achieve this, other rollers are made to rotate in response to the rotation of the developing roller 22 (i.e., rotation of the sleeve).

The rotational force of the center axis 30 is transmitted to the blocking plate 38 via the spring clutch 39 in response to the rotation of the second stirring roller 25. That is, the solenoid 44 is energized to attract the upper end of the armature 43 to the solenoid 44 in the direction to disengage it from the pawl, thus causing the stopper 52 in the upper end of the armature 43 to disengage from the pawl 41. This in turn causes the spring 50 to clamp the boss block 46*a* of the center axis in response to the rotation of the center axis 30, the rotational force being transmitted from the second hub 49 and the first hub 47 to the flange 37 to rotate the blocking plate 38.

Then, when the solenoid 44 is de-energized, the upper end of the armature 43 is released from the solenoid 44, which allows the return spring 45 to work to move the upper end of the armature 43 in the direction to engage it with the pawl, thus causing the stopper 52 to engage with the adjacent pawl 42. This engaging operation in turn causes the spring 50 to loosen, disabling transmission of the rotational force of the center axis 30 to the first and second hubs 47 and 49 and therefore stopping the rotation of the blocking plate 38. This means that the rotation is so controlled that the blocking plate 38 stops after rotating 90 degrees. When the blocking plate 38 stops after rotating 90 degrees, as shown in FIG. 4, the openings 38*a* between the blocking plates 38 come to the positions facing the entrance 35*a* and exit 35*b* of the developer supply passage to open the passage. Thus, the developer, while being stirred by the second stirring roller 25, is distributed to the developing roller 22 to be used for developing.

The toner density is detected by the detecting element of the toner density detecting sensor 28, which is positioned in the developer tank 4 in a location where the developer is supplied to the developing roller 22. In response to the detection output, supply of toner from the supply tank 20 to the developer tank 4 is controlled. Also, the protrusion 60 on the clutch cover 40 is made to press the actuator of the detecting switch 61 which notifies the control section of the copying machine that the blocking plate 38 is in the position to open the passage and the unit is in a developing condition.

As described above, the developer is supplied to the developing roller 22, and after the developing is completed, the developer is fed to the transport roller 23 by the rotation of the developing roller 22. The transport roller 23 further transports the developer upward, the developer being recirculated through the path along the partition plate 26 to the second stirring roller 25.

After that, when the developing of the photoconductor 3 is completed and the developing by the developing unit becomes unnecessary, control is performed to stop the further supply of developer. To achieve this, the solenoid 44 is energized to disengage the upper end of the armature 43 from the pawls 41 and 42, after which the solenoid 44 is de-energized, causing the blocking plate 38 to stop after rotating 90 degrees via the spring clutch 39, thus closing the entrance 35*a* and exit 35*b* of the developer supply passage.

Supply of the developer to the developing roller 22 is thus prevented, putting the unit into a non-developing condition. Also, the detecting switch 61 is put into an inactive state to notify the state to the control section of the copying machine.

In such closing and opening operations of the blocking plate 38, if the rotational center axis 30 of the blocking plate 38 comes out of alignment with the center of the coil spring 50, the rotational force can be transmitted from the input side of the spring clutch 39 to the second hub 49 because part of the spring 50 is pressed to contact the boss block 46*a* even when the blocking plate 38 is in a stop position. In such a case, it would be possible to consider provision of a position correcting device in which the fixing screw 53 of the first hub 47 is loosened to rotate the blocking plate 38 about the center axis 30 and re-fix it into position. This could, however, prevent the transmission of the driving force from the spring clutch to the blocking plate 38 because of the tightening torque of the fixing screw 53, resulting in slipping of the driving force, or cause the center of the clutch to become disaligned.

According to the present invention, on the other hand, the screws 56*a* and 56*b* of the clutch fixing plate 57 of the correcting mechanism 55 are loosened to slide the fixing plate 57, thus changing the position of the position detecting switch 61 to adjust the opening or closing operation point of the blocking plate 38. Also, because the adjustment of the screws 56*a* and 56*b* can be made on one side of the developer tank 4, it is easy to work on adjustment.

This invention is not restricted to the above embodiment, and it must be appreciated that numerous modifications and changes may be made to the above embodiment within the scope of the invention.

For example, in the above embodiment, the developing roller 22 and the transport roller 23 are disposed in a vertical array, but the invention is applicable in the case of the rollers disposed in a horizontal array side by side with each other.

Furthermore, the arranging order of the plurality of magnetic poles of the magnet member is not restricted to what is described in the above embodiment. Also, the photoconductor 3 is not restricted to the belt-like form as described in the above embodiment, but can be a drum-like form. The invention is also applicable to the unit with one developer tank instead of a plurality of developer tanks. Further, it can be so constructed in the above embodiment that the angle closed by the blocking plate is made larger than the angle opened by the opening so as to completely prevent the distribution of developer to the developing roller caused by variations in the stopping position of the blocking plate.

As described above, the developing unit of this invention is provided with a stopping position correcting mechanism, which absorbs the dragging of the shut-off device caused by the spring force within the clutch even if the center axis of the shut-off device becomes more or less disaligned with the center shaft of the spring clutch, thus holding the shut-off device in a fixed stopping position.

Furthermore, the correcting mechanism comprises a clutch fixing plate mounted with screws on the outer wall of the developer tank in a slidable way around the center axis, and a protrusion formed on the clutch case in a way to engage with a notch in the clutch fixing plate, and thus, the fixing plate can be made to slide by loosening the screws and the adjustment of the screws can be made on one side of the developer tank, which makes it possible to provide stable open/close operating performance of the blocking plate, and which makes it easy to work on adjustment.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developing unit comprising:

a developing roller disposed in a developer tank in a location facing a recording medium;

a supply passage for supplying developer to the developing roller;

a shut-off device that is rotatable about the center axis thereof for opening and closing the supply passage;

switching means that is provided with a spring clutch for transmitting rotational driving force to the shut-off device and is used for switching the shut-off device between the open and closed states; and a stopping position correcting mechanism for preventing variations in the stopping position of the shut-off device, said correcting mechanism having a clutch fixing plate mounted with screws on the outer wall of the developer tank such that the position of the clutch fixing plate is adjustable around the center axis of said shut-off device and an engaging plate projecting from said clutch fixing plate and engaging with the case of said spring clutch.

2. A developing unit according to claim 1, wherein the center axis of said shut-off device is connected to a driving means so as to rotate around the axis thereof.

3. A developing unit according to claim 2, wherein the center axis of said shut-off device is the center axis of a stirring roller for stirring developer within the developer tank.

4. A developing unit according to claim 3, wherein said shut-off device comprises flanges rotatably mounted on both ends of said center axis thereof, a pair of arch-shaped blocking plates fixed on the circumferences of said flanges, and a pair of arch-shaped openings formed between said two blocking plates.

5. A developing unit according to claim 4, wherein said spring clutch is covered with a clutch cover that is provided with projections projecting radially of said center axis of said shut-off device to correspond with the position of said blocking plates.

6. A developing unit according to claim 5, wherein a blocking plate position detecting switch is mounted on said clutch fixing plate of said developer tank.

7. A developing unit according to claim 6, wherein said projections actuate said blocking plate position detecting switch.

8. A developing unit according to claim 7, wherein said screws of said clutch fixing plate of said correcting mechanism are loosened to slide said fixing plate, so that the position of said position detecting switch is changed to adjust the opening or closing operation point of said blocking plates.

* * * * *